US007859381B2

(12) United States Patent
Chen et al.

(10) Patent No.: US 7,859,381 B2
(45) Date of Patent: Dec. 28, 2010

(54) AUTOTRANSFORMER USING PRINTED WIREBOARD

(75) Inventors: Keming Chen, Torrance, CA (US); Mike Kirkland, Van Nuys, CA (US); Michael A. Quan, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 181 days.

(21) Appl. No.: 12/217,424

(22) Filed: Jul. 5, 2008

(65) Prior Publication Data

US 2010/0001824 A1 Jan. 7, 2010

(51) Int. Cl.

| | |
|---|---|
| ***H01F 5/00*** | (2006.01) |
| ***H01F 21/04*** | (2006.01) |
| ***H01F 21/02*** | (2006.01) |
| ***H01F 27/28*** | (2006.01) |
| ***H01F 27/30*** | (2006.01) |

(52) U.S. Cl. ..... 336/200; 336/123; 336/145; 336/147; 336/183; 336/198

(58) Field of Classification Search ..... 336/123, 336/131, 138, 145–148, 195, 198, 200, 232
See application file for complete search history.

(56) References Cited

U.S. PATENT DOCUMENTS

| | | | | |
|---|---|---|---|---|
| 4,873,757 | A * | 10/1989 | Williams | 29/602.1 |
| 5,604,673 | A * | 2/1997 | Washburn et al. | 363/147 |
| 5,949,191 | A * | 9/1999 | Cassese et al. | 315/82 |
| 6,211,767 | B1 * | 4/2001 | Jitaru | 336/200 |
| 6,628,531 | B2 | 9/2003 | Dadafshar | |
| 6,914,508 | B2 | 7/2005 | Ferencz et al. | |
| 7,248,138 | B2 * | 7/2007 | Chiang et al. | 336/200 |
| 2008/0231403 | A1 * | 9/2008 | Hsu | 336/180 |

FOREIGN PATENT DOCUMENTS

JP 03183106 A * 8/1991

OTHER PUBLICATIONS

NASA Workmanship standards Jun. 27, 2002.*

* cited by examiner

*Primary Examiner*—Elvin G Enad
*Assistant Examiner*—Ronald W Hinson
(74) *Attorney, Agent, or Firm*—Oral Caglar, Esq.

(57) ABSTRACT

An autotransformer for use in low frequency, high power applications that uses a stack of printed wire boards constructed of a top, inner, and bottom layer including electrical trace windings circumventing the transformer core and formed in the inner layer for direct thermal contact with a heat sink interface providing a uniform and consistent heat path down to the heat sink plate. The autotransformer further includes a board to board connection employing solder cups to electrically connect between predetermined printed wire board traces. The printed wire board autotransformer also may use a non-planar interface for thermal interface with a non-planar heat sink plate surface.

16 Claims, 9 Drawing Sheets
(2 of 9 Drawing Sheet(s) Filed in Color)

AUTOTRANSFORMER USING PRINTED WIREBOARD

BACKGROUND OF THE INVENTION

The present invention relates generally to the field of autotransformers and more particularly to autotransformers employing printed wire board windings.

The demand for a low weight, low-cost and high-power-density transformer has pushed the transformer made through some traditional manufacturing methods to its limit. Generally, as current is run through a transformer, the wire resistance generates energy loss as heat.

FIG. 1 is a schematic of an exemplary three phase, 18-pulse autotransformer circuit 100 according to the prior art. Such an electrical circuit is one design used in aerospace applications to meet certain input harmonic distortion requirements. The autotransformer has three phases: Phase 1; (150), Phase (2); 160, Phase 3; (140). Phase 1 (150) includes an input 110 (P1), three outputs 130, (S3, S7, S5), and six windings 120 (A-F). Phase 2 (160) includes an input 110 (P2), three outputs 130, (S1, S6, S8), and six windings 120 (A-F). Phase 3 (140) includes an input 110 (P3), three outputs 130, (S2, S4, S9), and six windings 120 (A-F). For illustrative purposes, the windings of respective phases may be considered interchangeable, in other words Phase 1 winding 120 F may be equivalent in gauge and turns as Phase 2 winding 120 F and Phase 3 winding 120 F.

In some traditional transformers, the windings are individually insulated magnetic wires wrapped in direct contact around a metallic core creating an upper half and a lower half of windings. It is known in the art to couple a heat sink plate to a transformer in an effort to draw heat away from the windings. In general, the bottom surface of a transformer winding is used for interface to the heat sink plate to remove the heat; however, an insufficient amount of winding bottom surface is generally flat enough and available for efficient thermal conduction.

It is also known in the art to further increase the power density in a transformer by using copper strips to draw the heat out parallel along a surface of the transformer core. Referring to FIGS. 2-3 an example prior art three phase 18-pulse autotransformer 101 is depicted in accordance with the schematic of FIG. 1. A transformer core 170 is inserted within three phases, Phase 3 (140), Phase 1 (150), and Phase 2(160). Each phase includes respective windings 120 with wire connections protruding from the windings serving as the inputs 110 (P3, P1, P2) Phase 3 also includes three outputs 130 (S2, S4, S9) that are similarly protruding wire connections as the inputs 110. Phase 1 similarly includes three outputs 130 (S3, S7, S5) and Phase 2 also includes three outputs 130 (S2, S4, S9). The flat surface area at the bottom of each phase winding may be about 40% of the total bottom surface area. One end of copper strips 180 are inserted under the core and in between winding layers. Heat is drawn out along a heat path HP along each strip where the other copper strip end may be in contact with a heat sink (not shown).

Referring specifically to FIG. 3, a cross-sectional side view of an exemplary phase in accordance with a transformer of the prior art shown in FIG. 2 is depicted. The windings 120 are designated A-F types in correspondence with similarly labeled windings in FIG. 1. The windings 120 are insulated from one another by insulation 185 typically 0.2 mm thick. Windings 120 may generally escalate in gauge thickness the closer the winding is to the core where winding types E are the outermost windings and winding types A are the innermost. Thus, a hot spot HS may build up in a localized area in the innermost windings as heat dissipation is hindered by the insulation wires and an obstructed path to the heat sink. This approach can increase the weight and price and also may limit heat sink performance by creating a long heat path. A hot spot can build up in the winding half that is not in contact with the copper strip and heat from that spot may need to travel through wire insulation, other winding layers and sometimes the core and other winding half until it reaches the copper strip. The copper strips can also add more space at the bottom of the transformer making for a non-planar surface which can make cooling of the transformer core through a supporting bracket less effective.

It is further known in the art to manufacture transformers employing printed wire boards that include trace windings. One example uses spiral windings on stacked and staggered individual printed boards to form primary and secondary windings and electrically connecting the windings to the main circuit board by internal vias as seen in U.S. Pat. No. 6,914,508 to Ferencz et al. Such designs do not address the heat path built up during heat generation. Additionally, they suffer from needing to stack together non-uniform sized printed boards and do not address forming electrical connections between the boards.

It is also known in the art to use printed wire boards to form a transformer connected together by using variable position vias and a pin and jumper system as shown in U.S. Pat. No. 6,628,531 to Dadashar. These kinds of printed wire board stacks suffer from not addressing heat path issues and also from requiring offset stacking in the interconnection of boards.

As can be seen, there is a need for an autotransformer using a printed wire board design that creates an improved heat path for withdrawal of heat from trace windings. Furthermore, it can be seen that there is a need for an improved interconnection of printed wire boards.

SUMMARY OF THE INVENTION

An autotransformer comprising a printed wire board constructed of a top, inner, and bottom layer framing a core window therethrough for insertion of a transformer core, and at least one electrical trace winding circumventing the transformer core and formed in the inner layer in proximate thermal conductivity with a heat sink interface and in electrical connection between the top and bottom layers.

In another embodiment of the invention, an autotransformer comprises a stack of multiple printed wire boards in planar interface with one another including a core window for inserting a core through the stack, the printed wire boards including respective internal electrical trace windings wound around the core, electrically plated vias formed on respective printed wire boards in alignment with another and electrically connected to the trace windings of respective printed wire boards, and a solder cup formed between the vias of two or more printed wire boards filled with electrically conductive material for electrical connection of the respective trace windings between two or more printed wire boards.

In yet another embodiment of the invention an autotransformer comprises a printed wire board constructed of a top, inner, and bottom layer in parallel juxtaposition framing a core window for insertion of a transformer core, a non-planar printed wire board surface for complementary interface and heat transfer with a heat sink non-planar interface, and at least one trace winding circumventing the transformer core and formed in the inner layer in thermal conductivity with the heat sink interface and in electrical connection between the top and bottom layers.

These and other features, aspects and advantages of the present invention will become better understood with reference to the following drawings, description and claims.

BRIEF DESCRIPTION OF THE DRAWINGS

The patent or application file contains at least one drawing executed in color. Copies of this patent or application publication with color drawings(s) will be provided by the Office upon request and payment of the necessary fee.

DETAILED DESCRIPTION OF THE INVENTION

Figure 1:
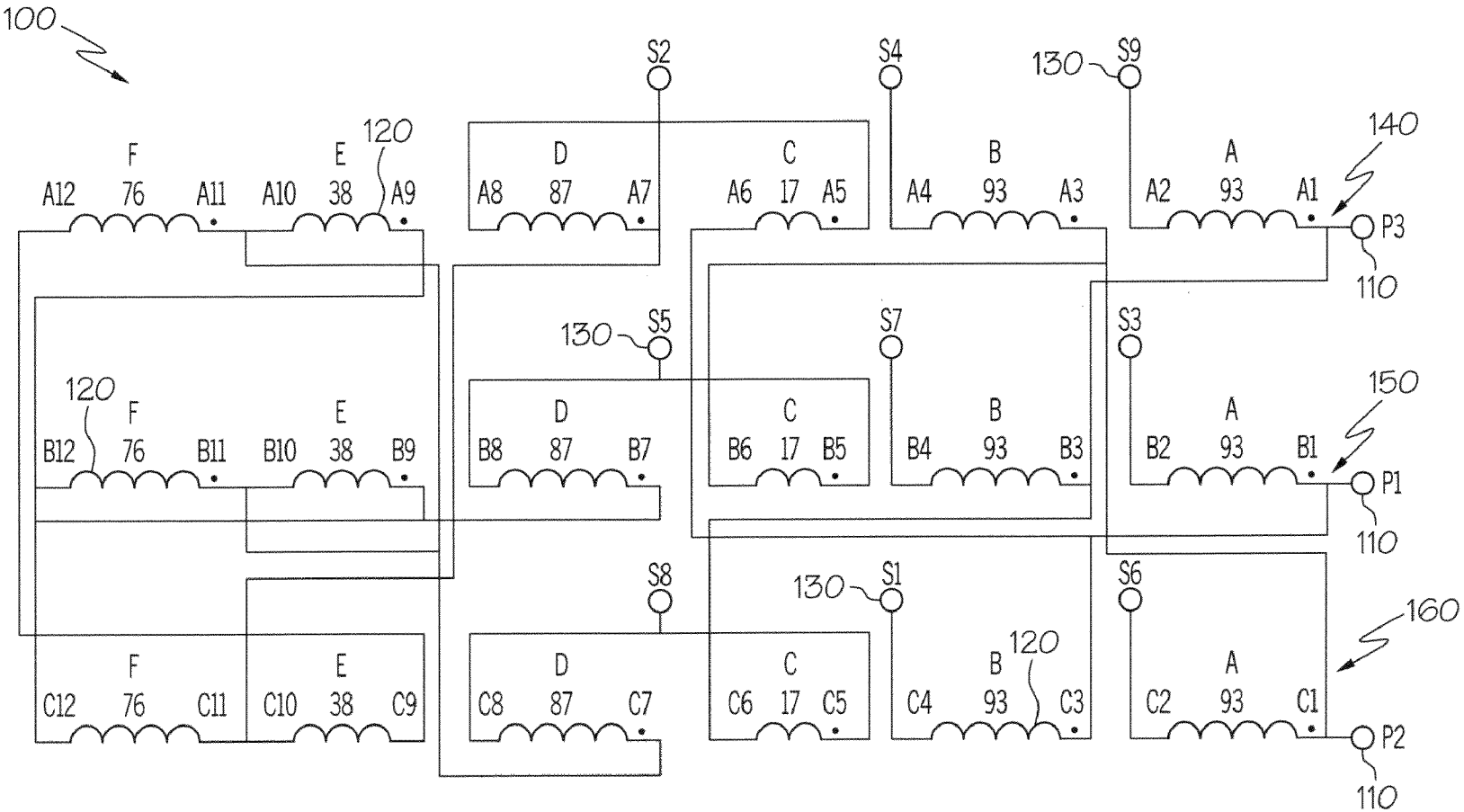
FIG. 1 (PRIOR ART)
FIG. 1 is a schematic representation of a three phase 18-pulse autotransformer of the prior art.
Figure 2:
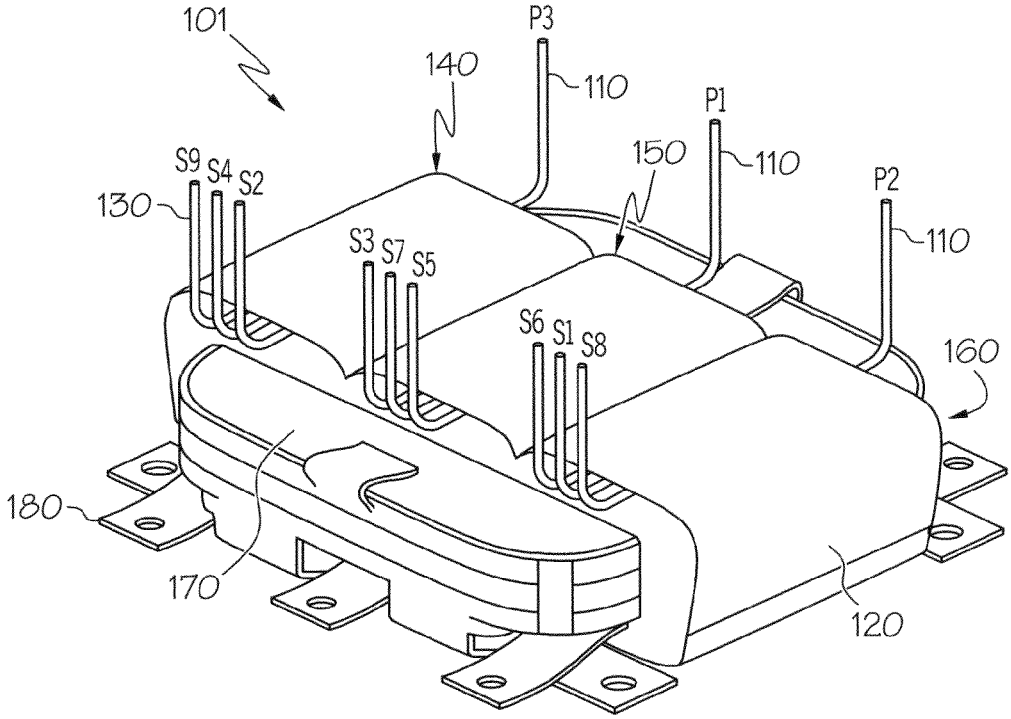
FIG. 2 (PRIOR ART)
FIG. 2 is a prior art three phase 18-pulse autotransformer.
Figure 3:
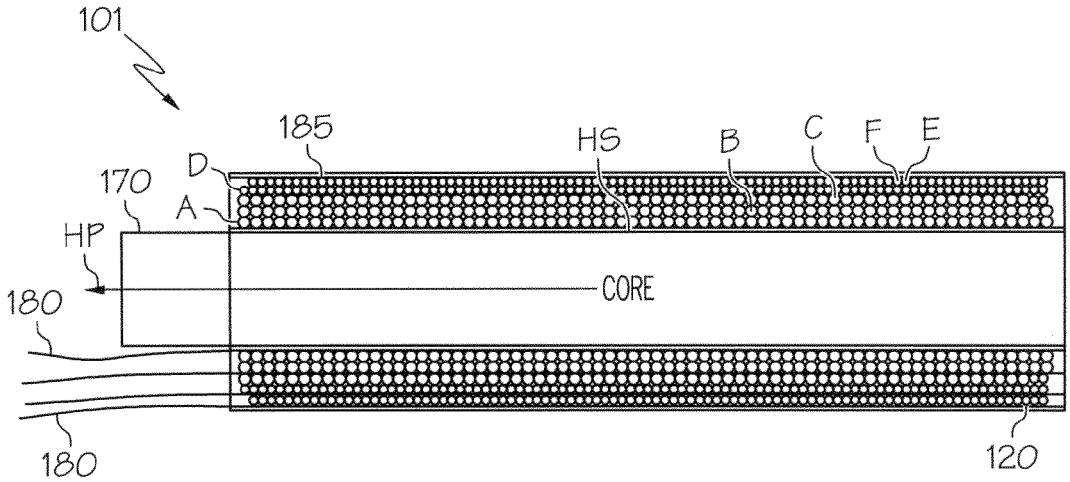
FIG. 3 (PRIOR ART)
FIG. 3 is a cross-sectional side view of the prior art autotransformer shown in FIG. 2.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The autotransformer of the present invention is described for exemplary use in low frequency, high power applications, for example circuits operating about the 50-400 Hz range and over 1 kW of power. One exemplary embodiment comprises a three-phase transformer for use in aerospace applications where power efficiency, weight loads and space efficiency are motivated by efforts to increase fuel efficiency.

The autotransformer of the present invention may employ printed wire boards with electrical trace windings that form a consistent, uniform and direct heat path to a heat sink plate. Unlike prior art transformers which wind wire around a core and draw heat out by contacting the wires with a copper strip, the trace windings of the present invention may be printed wound within circuit board layers and in proximate thermal conductivity with a heat sink plate surface. Additionally, another embodiment of the present invention may employ a layer to layer connection among printed wire boards using solder cups to electrically connect different boards together. Also, by using printed wire boards, another embodiment of the invention may create a complementary non-planar interface surface with non-planar heat sink plates.

Referring to FIGS. 4-8, a three phase autotransformer 200 using printed wire boards 225 of the present invention is shown. The autotransformer in general, includes a printed wire board 225 made with and referring respectively to, FIG. 6 a top layer 310, FIG. 7, a bottom layer 320, and FIG. 5, one or more inner layers 330. As depicted in a cross-sectional side view in general in FIG. 8, the layers may laid one atop another where a top layer 310 and a bottom layer 320 sandwich one or more inner layers 330 to form a printed wire board 225 (shown thrice in back to back to back formation as PCB #s 1-3 (printed wire boards 225 a-c)) which is then mounted upstanding onto a heat sink plate 300. The inner layer 330 may contain a trace winding 285 in proximate thermal conductivity with the heat sink plate 300.

Figure 4:
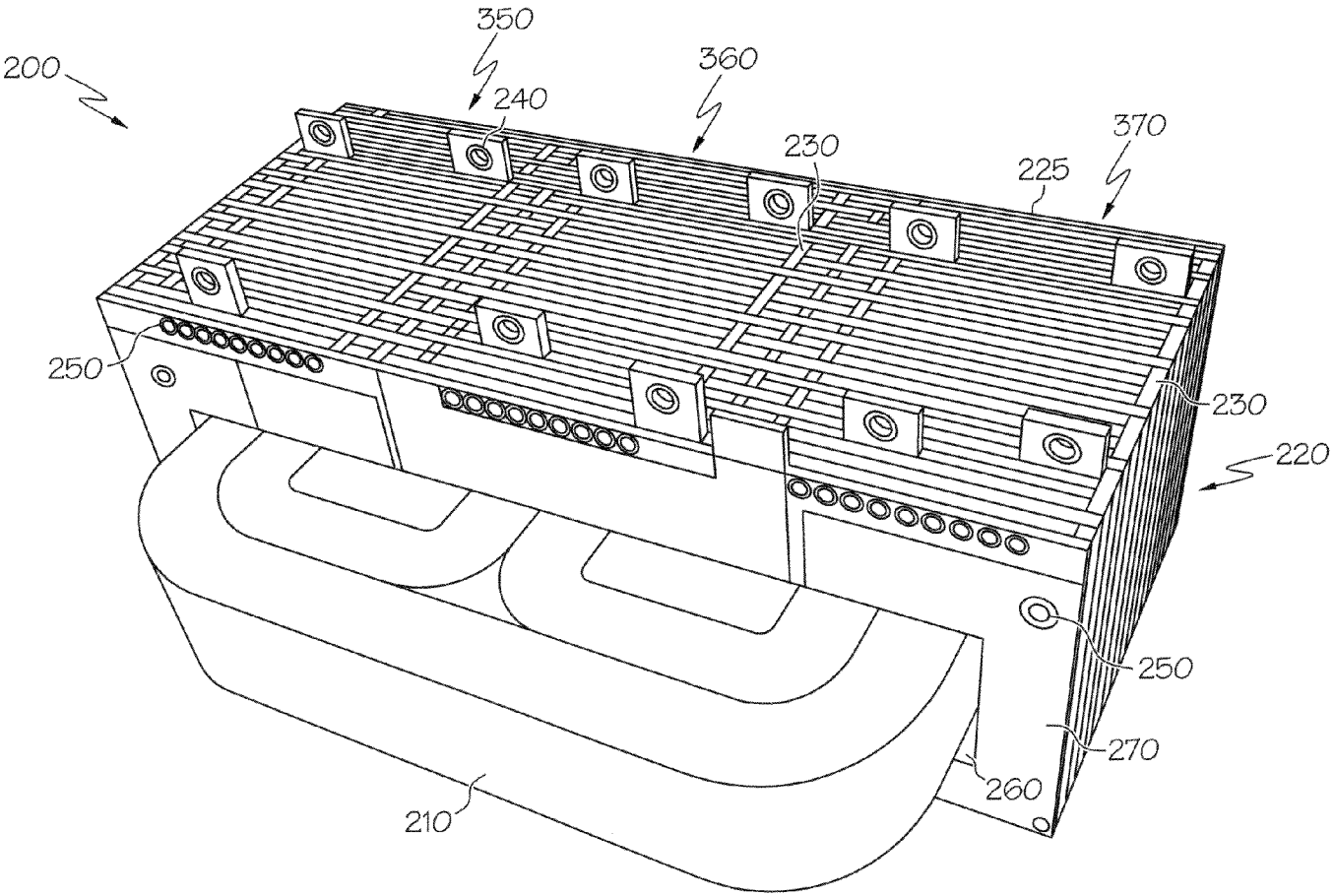
FIG. 4 is an elevated perspective view of a three phase autotransformer embodiment using a stack of printed wire boards according to the present invention.

Referring specifically to FIG. 4, one exemplary embodiment of the autotransformer 200 stacks 32 printed wire boards 225 in planar juxtaposition to form a printed wire board stack 220. Each printed wire board 225 mounted back to back in the stack defines respective core windows 260 in each of phases Phase 1 (360), Phase 2 (370) and Phase 3 (350) for insertion of the transformer core 210. Electrical connection tabs 240, vias 250 and solder cups 230 may be located on different board locales for effecting electrical connections with external devices and between individual printed wire boards. The printed wire boards may use, for example, a standard industrial insulated pre-preg material construction.

Figure 5:
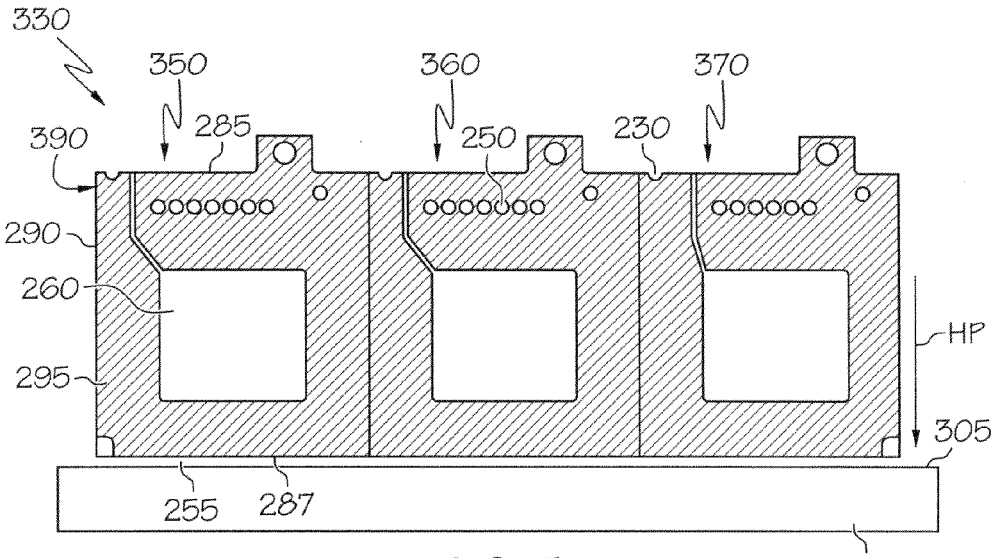
FIG. 5 is a cross-sectional front view of an inner layer of a printed wire board shown in FIG. 4.
Figure 6:
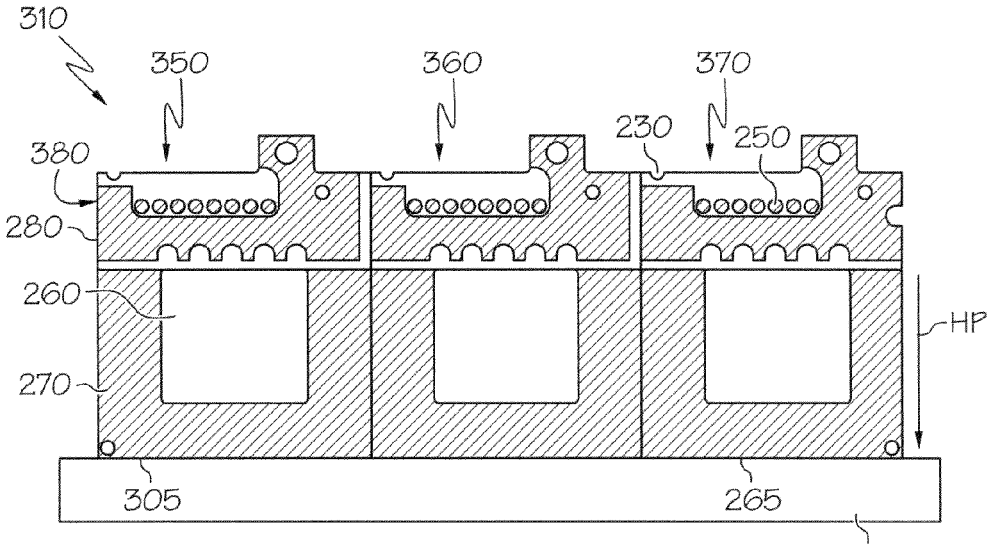
FIG. 6 is a cross-sectional front view of a top layer of a printed wire board shown in FIG. 4.
Figure 7:
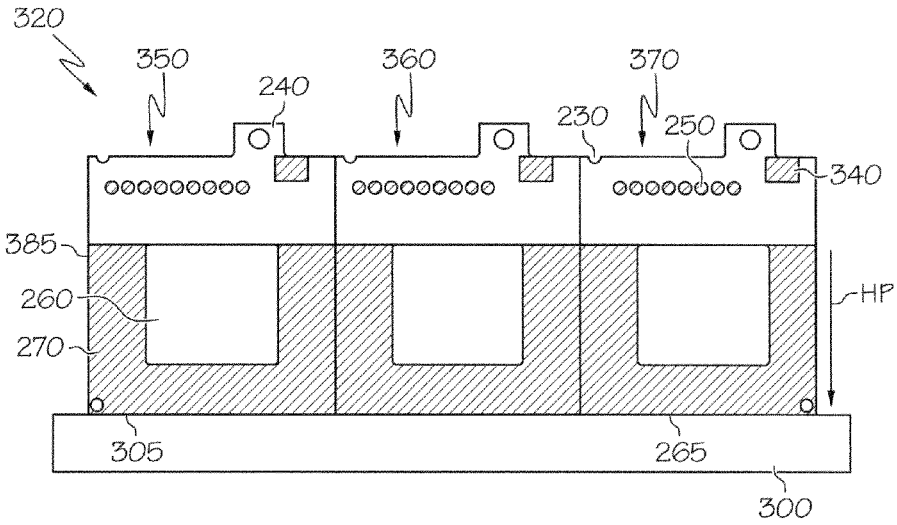
FIG. 7 is a cross-sectional front view of a bottom layer of a printed wire board shown in FIG. 4.

FIGS. 5-7 show front views of exemplary details for trace patterns 380, 385, and 390 formed in sections respectively in each layer: inner layer 330 FIG. 5; top layer 310 FIG. 6; and bottom layer 320 FIG. 7. The three layers together may form a single printed wire board 225 (which then can be stacked together as seen in FIG. 4). When the printed wire board 225 is constructed, the trace patterns 390, 380, and 385 may be electrically connected together to form a trace winding 285 with assistance from vias 250, and connecting pads 340 and the trace winding 285 defines the heat path HP flowing toward the heat sink plate 300. For the sake of convenience, each respective layer's trace pattern (390, 380, and 385) described is representing a pattern for each turn of a phase of the transformer 200. The trace windings 285 can be a flat copper trace turned in a single winding about the perimeter of a printed wire board layer 225. Multiple trace windings in successive layers may be of uniform dimensions or tailored to individual dimensions for a specific output.

Referring specifically to FIG. 5, one example trace pattern 390 for an inner layer 330 is shown for a rectangular trace winding 285 separated into two areas, a top trace portion 290 and a bottom trace portion 295. The top trace portion 290 may be farthest from the heat sink plate 300 and may be laid using a predetermined width. The trace pattern 390 begins in the top trace portion 290. The bottom trace portion 295 which is closer to the heat sink has relatively thinner track width.

FIGS. 6 and 7 show the trace patterns 380 and 385 of the top layer 310 and bottom layer 320 respectively. In both the top layer 310 and bottom layer 320, an electrically isolated trace surrounding the bottom and sides of each core window 260 serves as a heat shunt 270 which includes a heat shunt bottom edge 265 in direct contact with the heat sink plate 300. In the top layer 310, a winding return trace 280 may be patterned above the core window 260 and heat shunt 270 defining a conductive path beginning at a protruding connection tab 240 and winding clockwise about a row of vias 250. The bottom layer 320 also includes a connecting pad 340 adjacent the connection tab 240.

Figure 8:
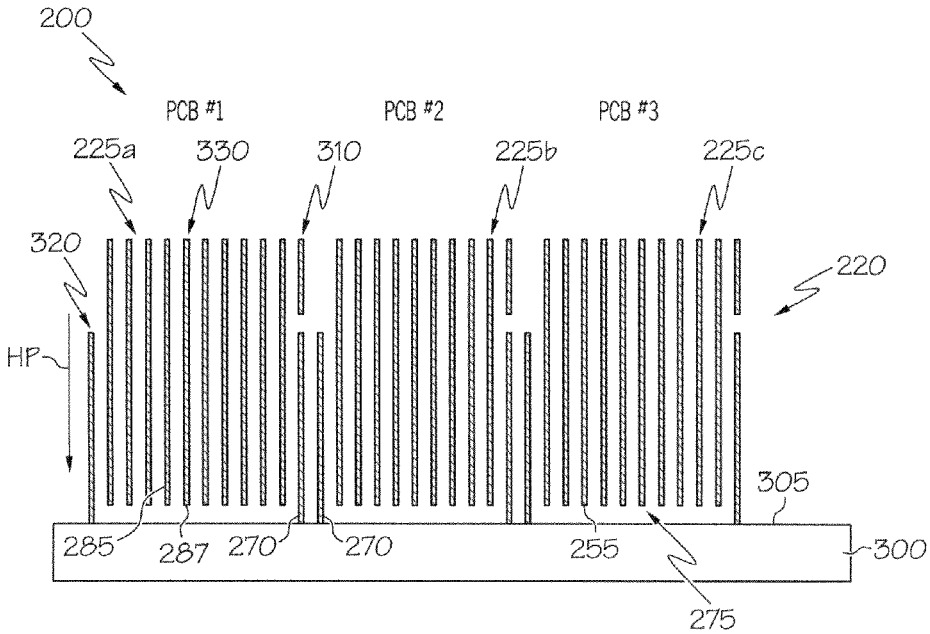
FIG. 8 is a partial cross-sectional side edge view illustrating three adjacent printed wire boards and their layers according to an embodiment of the present invention shown in FIG. 4.

Referring to FIG. 8, a cross sectional side edge view illustration of the autotransformer 200 using a representative stack 220 of three printed wire boards 225*a-c* in parallel is depicted. For clarity, the transformer core has been omitted however, it would be understood to run through the stack 220 latitudinal and planar to the heat sink plate 300. Each vertical line represents an edge view of a trace within a printed wire board 225 as seen from the side without the pre-preg material. In one exemplary assembly, there may be in each printed wire board 225*a-c*, from left to right, 1 bottom layer 320, 10 internal layers 330, and 1 top layer 310. Thus, the heat shunt 270 of the top layer 310 of printed wire board 225*a* would be directly adjacent to the heat shunt 270 of the bottom layer 320 of printed wire board 225*b*. The same arrangement continues for successive stacking between consecutive printed wire boards such as that seen again between printed wire boards 225*b* and 225*c*. Within an individual printed wire board, an exemplary inner layer 330 may contain 10 individual layers each with a single turn winding sandwiched between the single layered top and bottom layers. The trace winding bottom edges 287 form an approximate planar surface, the winding bottom plane 275, for thermal contact with the heat sink plate 300. An insulation gap filled with pre-preg epoxy material 255, about ten mils wide may separate the winding bottom plane 275 from the heat sink plate interface surface 305.

Figure 9:
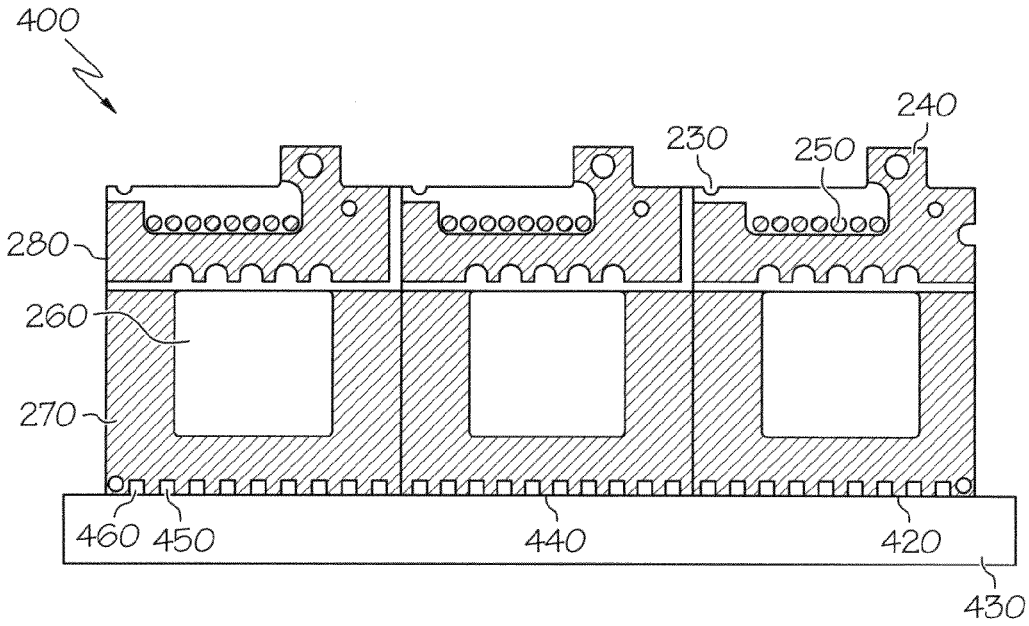
FIG. 9 is a cross-sectional front view of a printed wire board top layer shown with a slot and notch wire board to heat sink plate interface according to another embodiment of the present invention.

In operation, as a current is transmitted through the autotransformer 200, electricity traveling along the flat trace windings 285 will want to generate a heat distribution along the path of least heat resistance. Current will travel within individual printed wire boards with trace windings 285 electrically insulated from one another by the pre-preg material surrounding each inner layer trace pattern 390 in predetermined thicknesses dependent on the application. In the inner layers 330, where the bulk of the conductive path may be located, the current may be spread across a wider area in the top trace portions 290 that may have a relatively thicker trace width than the bottom trace portions 295. Thus, as current travels along the trace pattern 390, it may encounter successively less area in the bottom trace portion 295 building a greater resistance in each individual layer bottom area relative to the top trace portions. In turn, heat generation may be more pronounced toward the winding bottom plane 275. However the bottom trace portions 295 are closer to the heat sink plate 300 where more heat can be removed by the heat sink. The insulation gap 255 and pre-preg material will prevent electrical conduction with the heat sink plate 300 but not be so wide as to hinder thermal conduction. Additionally, lateral heat dissipation may be controlled by the heat shunts 270 whose thermal conductivity may facilitate a thermal flow toward the heat sink plate 300. Thus, the hottest portions may be nearest the top of the trace which is further away from the heat sink plate 300 and heat may flow gradually uniformly along the heat path HP from the top toward the heat sink Referring to FIG. 9, yet another embodiment of the present invention shows a different heat sink to transformer interface. The autotransformer 400 is similar to the autotransformer 200 except that printed wire boards may be modified for creating an interface with a non-planar heat sink 460. In situations where the heat sink plate 460 does not use a flat surface or where an increase in thermal interface area may be desired, the printed wire board bottom surface 440 may be customized to create a complementary interface. The printed wire board material can be exploited to form non-planar shapes where, when stacked together the printed wire board bottom surfaces 440 can be formed into a non-planar printed wire board interface 420 to match in complementary index with the non-planar heat sink interface surface 450. One example is illustrated using a notch and slot interface, however it will be understood that the shape of the non-planar printed wire board interface may be dependent on the shape of the heat sink interface surface. Thus, as heat is generated within the windings, thermal conduction can be facilitated by exposing a greater winding surface area to the heat sink plate. Also, once again, the heat shunts may mitigate lateral heat dissipation and facilitate heat flow toward the heat sink plate.

Figure 11B:
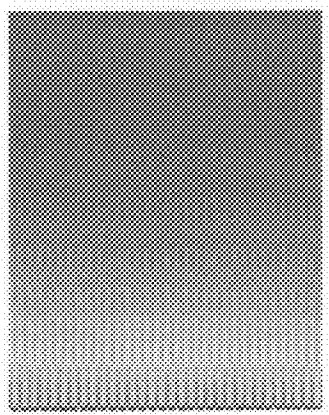
FIG. 11 is a front and side view of the thermal model shown in FIG. 10.
Figure 11A:
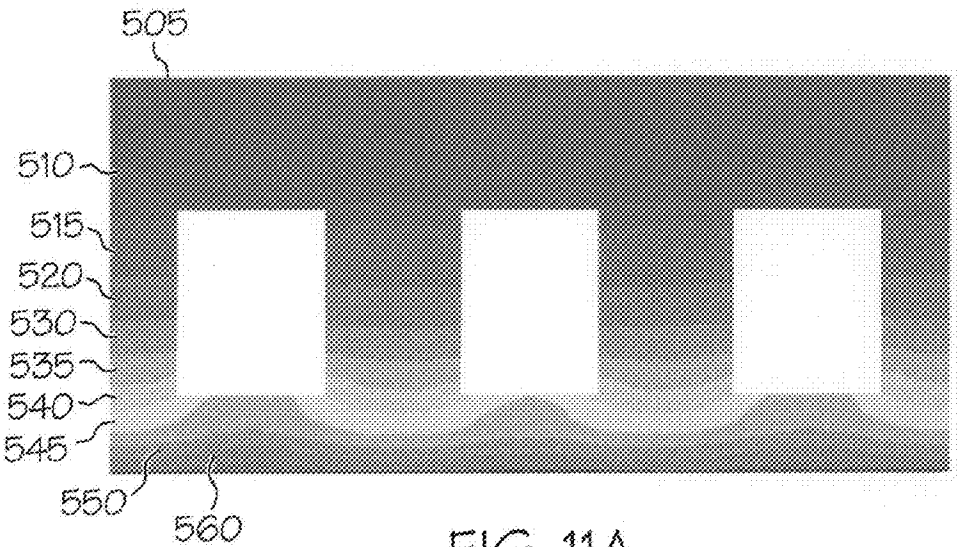
Figure 10:
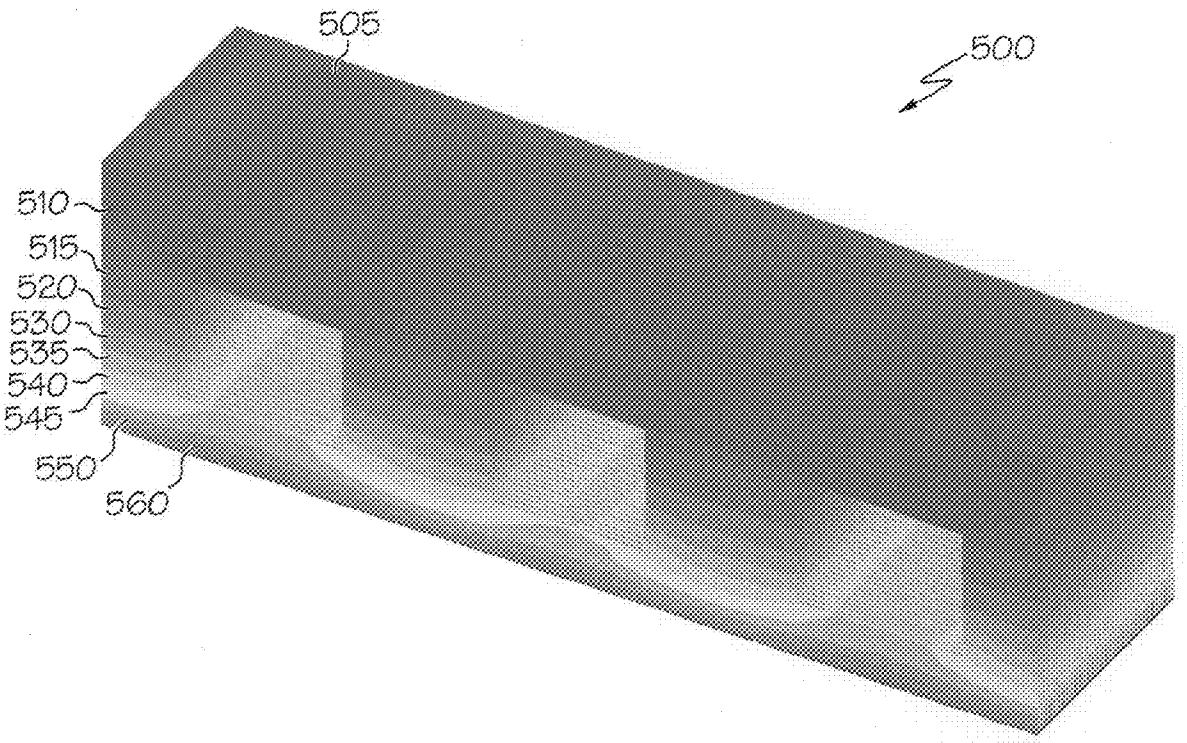
FIG. 10 is an isometric view depicting a thermal model of the autotransformer shown in FIG. 4.

Referring to FIGS. 10 and 11, thermal models showing heat distribution of the autotransformer 200 in operation are shown. For reference, the heat sink plate not shown would be below the model. In one exemplary performance model 500, the lower areas, which may generally produce more heat because of the thinner trace widths, are immediately cooled by the heat sink leaving the upper areas hotter than the lower areas. In general, regions of heat uniformly cool across descending heat strata. For example, region 1 (505) represents a stratum measuring approximately 120° C., region 2 (510) measures about 117° C., and region 3 (515) about 111° C. Temperatures continue to cool in region 4 (520), measuring 108° C., then in region 5 (530) measuring about 105° C., region 6 (535) measuring about 102° C., and in region 7 (540) cooling to 99° C. The trend may continue the closer the strata are to the heat sink interface, as region 8 (545) measures approximately 96° C. and region 9 (550) about 93° C. The lowest composite region 10 (560) may be below 90° C. and approaches temperatures about 30° C. around the heat sink interface. Thus, as depicted by this exemplary model, heat generation may be consistent across printed wire boards where the top edge of the first stack is about as hot as the top edge of the last stack and their respective bottom edges are similarly as cool as one another. Hence, heat may flow gradually and uniformly around the core window area and down in a direction toward the heat sink plate.

Figure 12:
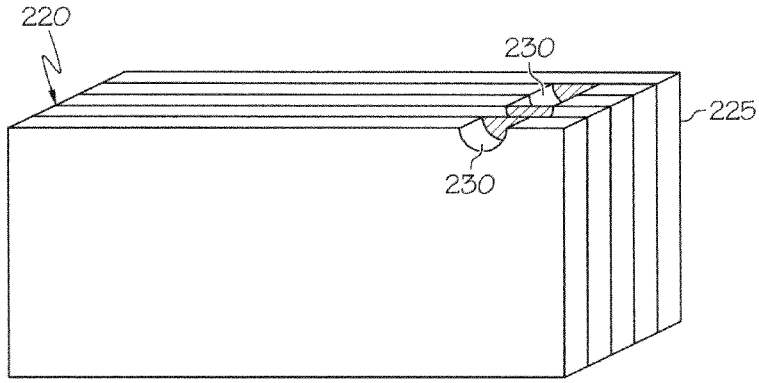
FIG. 12 is a perspective view of a board to board connection according to another embodiment of the present invention.
Figure 13:
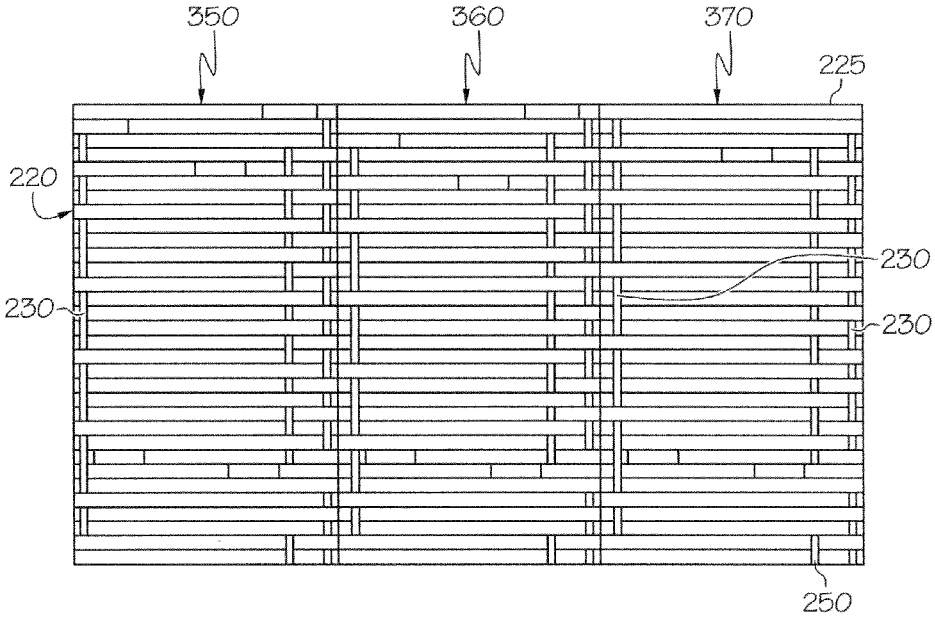
FIG. 13 is a top view of the autotransformer showing board to board connections shown in FIG. 12.

Referring to FIGS. 12 and 13, another embodiment of the present invention illustrates a layer to layer connection using a printed wire board stack 220. Vias 250 between successive printed wire boards may be formed in longitudinally linear alignment. Preselected vias may be electrically plated for facilitating an electrical connection therethrough with other vias and with the internal trace patterns of respective printed wire board layers. One exemplary manner of forming an electrical connection involves forming pre-aligned half hole vias on the outer surfaces of the printed wire boards and filling successive vias with a conductive material such as solder to create solder cups 230.

In operation, by employing solder cups, printed wire boards may be stacked uniformly and in un-staggered alignment. Trace pattern positions can be left undisturbed as connections between individually desired printed wire boards may be maintained using pre-positioned via pathways. Thus, an autotransformer may be manufactured with a standard pre-set number of windings and subsequently modified by selectively effectuating connections between boards thereby controlling the number of active windings in each phase.

While the present invention has been described using a rectangular three phase autotransformer, it will be understood that modifications can be employed to customize the transformer for intended applications. For example, it will be understood that the present invention may be adapted to single, dual, and multi-phase transformers other than three phase. Additionally, printed wire boards using the present invention can be shaped to maximize space and weight constraints other than rectangular configurations.

It should be understood, of course, that the foregoing relates to exemplary embodiments of the invention and that modifications may be made without departing from the spirit and scope of the invention as set forth in the following claims.

We claim:

1. An autotransformer comprising:

a transformer core;

a printed wire board constructed of a top, inner, and bottom layer framing a core window therethrough for insertion of the transformer core; and at least one electrical trace winding circumventing the transformer core and formed in the inner layer in proximate thermal conductivity with a heat sink interface and in electrical connection between the top and bottom layers; the trace winding comprising:

an upper trace portion located a first distance from the heat sink interface; and a lower trace portion located a second distance, smaller than the first distance, from the heat sink interface;

wherein the upper trace portion has a first thickness;

wherein the lower trace portion has a second thickness smaller than the first thickness so that electrical conductivity of the upper trace portion is higher than electrical conductivity of the lower trace portion; and whereby the lower trace portion, closer to the heat sink interface than the upper trace portion, is heated more than the upper trace portion by passage of current though the trace winding.

2. The autotransformer of claim 1:

wherein the top and bottom layers include a bottom portion respectively, each bottom portion including a heat shunt; and wherein the top and bottom layers sandwich the inner layer trace winding.

3. The autotransformer of claim 1, further comprising a connection tab electrically connected to the electrical trace winding.

4. The autotransformer of claim 1, further comprising multiple stacks of the printed wire boards in planar juxtaposition including respective trace windings and further including electrical connections for connecting the trace windings among respective printed wire boards.

5. The autotransformer of claim 4, further comprising connecting pads on respective printed wire boards for electrical connection between predetermined wire boards.

6. The autotransformer of claim 1, wherein the top layer includes a winding return.

7. The autotransformer of claim 1, wherein the printed wire board includes ten of the inner layers.

8. An autotransformer comprising:

a stack of multiple printed wire boards in planar interface with one another including a core window for inserting a core through the stack, the printed wire boards including respective internal electrical trace windings wound around the core;

electrically plated vias formed on respective printed wire boards in alignment with another and electrically connected to the trace windings of respective printed wire boards; and a solder cup formed between the vias of two or more printed wire boards filled with electrically conductive material for electrical connection of the respective trace windings between two or more printed wire boards;

a winding bottom plane formed by adjacent electrical trace windings; and a heat sink plate in thermal conductivity with the winding bottom plane;

wherein lower portions of the trace windings, closer to the bottom plane than upper portions of the trace windings, have a lower electrical conductivity than the upper portions of the trace windings.

9. The autotransformer of claim 8, wherein respective printed wire boards include top and bottom layers surrounding the trace windings, respective top and bottom layers including connecting traces in electrical connection with the trace windings and the solder cups.

10. The autotransformer of claim 8, wherein the solder cups serially connect one printed wire board to multiple printed wire boards forming an electrical path.

11. The autotransformer of claim 8, wherein the solder cups form an electrical connection between printed wire boards directly adjacent to one another.

12. The autotransformer of claim 9, wherein the top and bottom layers include a bottom portion respectively, each bottom portion including a heat shunt sandwiching the inner layer trace winding.

13. The autotransformer of claim 8, wherein the internal electrical trace windings are formed in an inner layer comprising the upper portion with a top trace portion and the lower portion with a bottom trace portion and wherein the bottom trace portion is thinner than the top trace portion.

14. An autotransformer, comprising:

a plurality of printed wire boards constructed as sets of a top, inner, and bottom layer in parallel juxtaposition and framing a core window therethrough for insertion of a transformer core;

electrically isolated traces between each set and surrounding a bottom and sides of each core window comprising heat shunt bottom edges in direct contact with a heat sink plate;

a non-planar printed wire board surface for complementary interface and heat transfer with a heat sink non-planar interface; and at least one trace winding circumventing the transformer core and formed in the inner layer in thermal conductivity with the heat sink interface and in electrical connection between the top and bottom layers;

wherein a to portion of the at least one trace winding is located a first distance from the heat sink plate;

wherein a bottom portion of the at least one trace winding is located a second distance, smaller than the first distance, from the heat sink plate, and wherein the heat shunts mitigate lateral heat dissipation and facilitate heat flow toward the heat sink plate.

15. The autotransformer of claim 14, wherein the heat sink non-planar interface and the non-planar printed wire board surface are fitted together in a slot and notch linkage.

16. The autotransformer of claim 15, wherein the trace windings include a notch and slot surface for complementary interface with the heat sink.

* * * * *